US006459030B1

(12) United States Patent
Di Paolo et al.

(10) Patent No.: US 6,459,030 B1
(45) Date of Patent: Oct. 1, 2002

(54) METHOD FOR PREVENTING POLYPHONY SHORTAGE IN AN ELECTRONIC ORGAN

(75) Inventors: Marco Di Paolo, Grottammare; Piero Cameli, San Benedetto del Tronto; Marco Sabatini, Ascoli Piceno, all of (IT)

(73) Assignee: Roland Europe S.p.A., Martinsicuro (IT)

( * ) Notice: Subject to any disclaimer, the term of this patent is extended or adjusted under 35 U.S.C. 154(b) by 0 days.

(21) Appl. No.: 09/931,935

(22) Filed: Aug. 20, 2001

(30) Foreign Application Priority Data

Apr. 27, 2001 (IT) ..... BO21A0254

(51) Int. Cl.[7] ..... G10H 1/24; G10H 7/00
(52) U.S. Cl. ..... 84/620; 84/345
(58) Field of Search ..... 84/343–345, 615, 84/620, 653, 678, 686

(56) References Cited

U.S. PATENT DOCUMENTS 5,054,358 A * 10/1991 Usami ..... 84/615 X
5,074,183 A * 12/1991 Chihana ..... 84/615
5,945,620 A * 8/1999 Adamson ..... 84/615

* cited by examiner

*Primary Examiner*—Jeffrey Donels

(57) ABSTRACT

A method for handling with polyphony limits in an electronic organ, that is provided with at least one keyboard, one pedalboard, a series of organ stops, which can be turned on by a user to determine which voices are assigned to each key and to each pedal, and with a sound module, which is provided with a number of independent sound generators; when a user turns on a number of organ stops exceeding a maximum number depending on the number of independent sound generators, some organ stops are automatically turned off according to a pre-determined selection rule, in order to have a number of really operating stops that does not exceed the mentioned maximum number.

22 Claims, 1 Drawing Sheet

METHOD FOR PREVENTING POLYPHONY SHORTAGE IN AN ELECTRONIC ORGAN

BACKGROUND OF THE INVENTION

Figure 1:
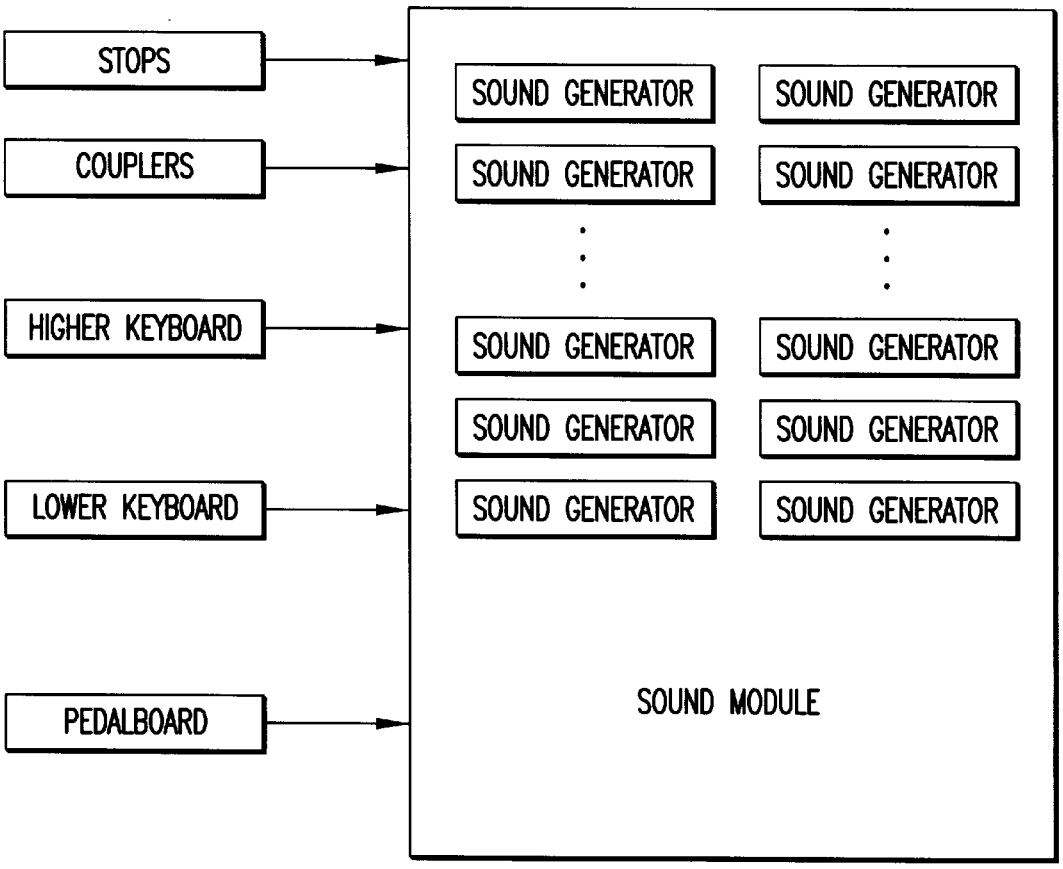

The present invention relates to a method to handle with polyphony limits in an electronic organ.

An electronic organ typically comprises: two keyboards (a higher and a lower keyboard), one pedalboard, a series of organ stops, which can be turned on by a user to determine which voices are assigned to each key and to each pedal, and with a sound module, which is provided with a number of independent sound generators.

Under normal operating conditions, when a user presses a key/pedal, the sound module activates some sound generators that generate all the active voices associated with a key/pedal independently. However the number of independent sound generators inside the sound module is limited and under particular conditions it can prove to be insufficient to simultaneously generate all the voices required by the user's commands; such kind of situation is usually referred to as "polyphony shortage", it results from the limited voice polyphony of the instrument and it may happen rather often: for example, a good electronic organ is usually provided with 128 independent sound generators, but the simultaneous generation of 252 independent voices is required in extreme operating condition, that is when all the 26 stops of the electronic organ are turned on, all couplers are turned on and the organist presses 10 keys and 2 pedals simultaneously.

In the state-of-the-art electronic organs, when a polyphony shortage occurs, polyphony limits are managed dynamically since instantaneously less significant voices are sorted out and suppressed, this meaning that in that precise moment some voices are evaluated by the sound module and judged as negligible in terms of a correct music perception by listeners. The dynamic suppression of instantaneously less significant voices is an effective method to cope with polyphony limits; however, the dynamic suppression of voices causes a decrease in the overall sound quality level because it brings about some slight though continual change in the sound composition. Moreover, a dynamic suppression of voices forces the sound module to sort out and eliminate a sometimes high number of voices in realtime, with a consequent remarkable utilization of calculation power; of course to assure the necessary calculation power under every circumstance, the sound module has to be provided with a powerful and therefore costly processor.

SUMMARY OF THE INVENTION

The purpose of this invention is to supply a method to handle with polyphony limits in an electronic organ, which is deprived of the above mentioned disadvantage while granting an easy and cost-effective implementation at the same time.

According to the present invention, a method is provided to handle with polyphony shortage in an electronic organ comprising at least one keyboard, one pedalboard, a series of organ stops that can be turned on by the user to associate certain voices to every key and every pedal, and a sound module, that is provided with a number of independent sound generators; the method comprising the step of:

determining a maximum number of organ stops, which can be turned on simultaneously, said maximum number depending on the number of the provided independent sound generators;

determining a selection rule for turning off said organ stops; and automatically turning off some organ stops according to said selection rule whenever a user turns on a number of stops exceeding said maximum number, so as to obtain a number of actually operating stops which does not exceed said maximum number.

DETAILED DESCRIPTION OF THE INVENTION

An electronic organ usually comprises a higher keyboard (also referred to as "swell" keyboard) including 61 keys, a lower keyboard (also referred to as "great" keyboard) including 61 keys, a pedalboard (also referred to as "pedal" keyboard) including 32 pedals, a series of organ stops that can be operated by a user to determine the voices to be associated with each key and each pedal, and a sound module provided with a number of independent generators; for example, a rather good electronic organ currently available on the market is provided with 128 independent sound generators.

Moreover, an electronic organ comprises 10 organ stops for the higher keyboard, which can be turned on altogether and that are sorted out among a series of at least 14 stops, another 10 stops for the lower keyboard, which can be turned on altogether and that are sorted out among a series of at least 15 stops, and 6 stops for the pedalboard, which can be turned on altogether and that are sorted out among a series of at least 10 stops. Most organ stops represent a single voice, that is when they are selected they associate a single voice to every corresponding key/pedal, but some of them represent two voices, that is when they are selected they associate two independent voices to every corresponding key/pedal.

Finally, an electronic organ comprises some couplers, which allow the stops selected by the keyboards to be associated also with the pedalboard and allow the lower keyboard to be associated also with the stops usually selected by the higher keyboard.

As explained above, it's obvious that, under the worst conditions, in which all the 26 organ stops as well as all couplers are turned on, if 10 keys and 2 pedals are pressed, the generation of 252 independent voices is theoretically required, this meaning that 252 independent sound generators should theoretically be provided against the 128 independent sound generators that are actually provided; such condition is commonly referred to as "polyphony shortage", it's due to the polyphony limits of electronic organs and it has to be handled with in such a way that it generates sounds that are as close as possible to the sounds generated by a pipe organ under the same operating conditions.

To cope with this polyphony limits, depending on the number of the independent sound generators provided in the sound module, a maximum number of stops that can be turned on simultaneously is determined, so that, when a user selects a number of stops that exceeds that limit, some selected stops are automatically turned off by the sound module, thus obtaining a number of really operating stops which does not exceed that maximum number. Obviously each stop representing two voices accounts for two stops in the calculation of the actually operating stops.

According to a preferred embodiment, the maximum number is determined so that, under the worst conditions, a possible residual polyphony shortage can be accepted, which would be handled with according to the known method of the dynamic suppression of the voices that are instantaneously recognized as negligible; for example, with 128 independent sound generators, the maximum number could be 16, since it still allows to press two pedals and eight keys under any circumstances without provoking any polyphony shortage.

According to a different embodiment, the maximum number is determined depending on the number of the provided independent sound generators so as to avoid that a polyphony shortage situation occurs under any circumstance.

As previously explained, when a user selects a number of stops exceeding the maximum number, some stops are automatically turned off by the sound module to obtain a number of actually operating stops that does not exceed said maximum number; if, later on, a user turns off at least one of the actually operating stops, thus bringing the number of the actually operating stops below the maximum number and making it smaller than the number of selected stops, the sound module automatically turns on again at least one of the previously turned off stops to reach the maximum number. To sort out which stops have to be turned off, the sound module applies a pre-determined selection rule, which will be described in detail further ahead; to sort out the stops to be reactivated, the sound module applies said selection rule inversely.

According to said pre-determined selection rule, if a stop has to be turned off, the stop relating either to the keyboard or the pedalboard is turned off, which features the largest number of operating stops; if a keyboard and the pedalboard have the same number of operating stops, a stop relating to the keyboard is turned off, whereas if both keyboards have the same number of operating stops, a stop relating to the higher keyboard is turned off.

Moreover, according to said pre-determined selection rule, under any operating condition, the number of the actually operating stops for each keyboard is not smaller than six.

Once it has been determined where a stop has to be turned off, that can be in the lower keyboard or in the higher keyboard or in the pedalboard, it has to be determined which stop is to be turned off; thanks to long and accurate listening checks as well as to theoretical studies on pipe organs, it could be noticed that the tone color of some stops is very similar to that of other stops, therefore their contribution to defining the overall organ sound can be perceived only if they are selected individually, but it's virtually unperceivable when they are combined with other stops.

According to what has been explained so far and according to the pre-determined selection rule, the most insignificant stop is always turned off, that is the stop with the smallest contribution to the definition of the overall organ sound; such method is embodied and summarized in the lists shown here below, which rate the importance of the stops relating to the pedalboard and to the keyboards.

According to said selection rule, if a stop relating to the upper keyboard has to be turned off, the following priority order is followed starting from the least important stop, which will be turned off first, up to the most important one, which will be turned off last: Flute Celeste II, Flauto Traverso 4', Prestant 4', Viole Celeste II, Nazard 2⅔', Bourdon 8', Blockflöte 2'.

According to said selection rule, if a stop relating to the lower keyboard has to be turned off, the following priority order is followed starting from the least important stop, which will be turned off first, up to the most important one, which will be turned off last: Gemshorn 8', Superoctave 2', Octave 4', Quinteflöte 1⅓', Waldflöte 2', Rohrflöte 8', Gedackt 8', Flute 4', Clarion 4', Krummhorn 4'.

According to said selection rule, if a stop relating to the pedalboard has to be turned off, the following priority order is followed starting from the least important stop, which will be turned off first, up to the most important one, which will be turned off last: Bourdon 8', Subbass 16', Octave 8', Trumpet 8', Choralbass 4'.

It is essential to notice that the deactivation of one or more organ stops to reach a number of actually operating stops which does not exceed the maximum number is not notified to the user, who will carry on playing and being convinced that he/she is playing with all the selected stops turned on and does not realize that some stops have been turned off because the sound contribution of the deactivated stops cannot be perceived under a "plenum" situation even by the most sensitive listeners, this meaning in a situation in which the organ sound is generated by all or almost all available stops.

As explained so far, it is clear that the above described method to handle with polyphony limits is fully applicable, by simply adjusting the used parameters, both when an electronic organ is provided with two or more keyboards as well as with only one keyboard.

By comparing the method of the dynamic suppression of the instataneously less significant voices with the method of the prevention of a polyphony shortage by deactivating some stops that are selected by the user in order to keep the number of actually operating stops below the maximum number, it is obvious that the method of turning off some stops that were selected by the user allows to achieve both a better sound quality as well as to avoid an excessive usage of calculation power.

Moreover, even if when applying the method of the deactivation of some stops that have been selected by the user a residual polyphony shortage may still occur under extreme circumstances, that may require a dynamic suppression of the instantaneously less significant voices, the real application of such suppression method results to be practically very rare and rather restricted in its application time, so it does not influence the overall sound composition essentially.

What is claimed is:

1. A method for preventing polyphony shortage in an electronic organ having at least one keyboard, one pedalboard, a series of organ stops that can be turned on by the user so as to associate certain voices to every key and every pedal, and a sound module having a number of independent sound generators; the method comprising the steps of:

determining a maximum number of organ stops, which can be turned on simultaneously, said maximum number of organ stops depending on the number of the provided independent sound generators;

determining a selection rule for turning off said organ stops; and automatically turning off some of the organ stops according to said selection rule whenever a user turns on a number of stops exceeding said maximum number, so as to obtain a number of actually operating stops which does not exceed said maximum number.

2. The method according to claim 1, wherein every stop representing two voices accounts for two stops when the number of actually operating stops is calculated.

3. The method according to claim 1, wherein whenever a user turns off at least one of the actually operating stops, thus bringing the number of the actually operating stops below said maximum number and also making it smaller than the number of stops selected by the user, at least one of the previously deactivated stops is automatically turned on again so as to obtain a number of actually operating stops that amounts to said maximum number.

4. The method according to claim 3, wherein to turn on again a stop that had been previously turned off, said selection rule is applied inversely.

5. The method according to claim 1, wherein said maximum number is determined depending on the number of the provided independent sound generators so as to avoid any polyphony shortage situation from occurring under any circumstances.

6. The method according to claim 1, wherein said maximum number is determined depending on the number of the provided independent sound generators so as to accept any residual polyphony shortage when a number of keys and pedals pressed exceeds a given limit.

7. The method according to claim 6, wherein any possible polyphony shortage is coped with by applying the procedure of the dynamic suppression of the instantaneously less significant voices.

8. The method according to claim 6, wherein said sound module is supplied with 128 independent sound generators and said maximum number amounts to 16 organ stops.

9. The method according to claim 6, wherein the simultaneous pressure of two pedals and eight keys does not cause any polyphony shortage.

10. The method according to claim 1, wherein according to said selection rule, under any operating conditions, the number of actually operating stops relating to the pedalboard is not smaller than a first minimum number.

11. The method according to claim 10, wherein said first minimum number amounts to four.

12. The method according to claim 1, wherein according to said selection rule, under any operating conditions, the number of actual operation stops relating to each keyboard is not smaller than a second minimum number.

13. The method according to claim 12, wherein said second minimum number amounts to six.

14. The method according to claim 1, wherein according to said selection rule, one stop relating to either a keyboard or the pedalboard is turned off depending on which one features the highest number of operating stops.

15. The method according to claim 14, wherein according to said selection rule, if a keyboard and the pedalboard have the same number of operating stops, one stop relating to the keyboard is turned off.

16. The method according to claim 14, wherein said electronic organ comprises a lower and a higher keyboard; according to said selection rule, if the keyboards have the same number of operating stops, one stop relating to the higher keyboard is turned off.

17. The method according to claim 1, wherein according to said selection rule, the stop is turned off whose contribution to the overall definition of the organ sound is the smallest.

18. The method according to claim 1, wherein said electronic organ comprises a lower and a higher keyboard;

according to said selection rule, if a stop relating to the higher keyboard has to be turned off, the following priority order will be applied starting from the most negligible stop, that will be turned off first, up to the most important one, that will be turn off last; the order of importance of the stop of the higher keyboard from the least important up to the most important being:

Flute Celeste II, Flauto Traverso 4', Prestant 4', Viole Celeste II, Nazard 2⅔', Bourdon 8', Blockflöte 2'.

19. The method according to claim 1, wherein said electronic organ comprises a lower and a higher keyboard; according to said selection rule, if a stop relating to the lower keyboard has to be turned off, the following priority order will be applied starting from the most negligible stop, that will be turned off first, up to the most important one, that will be turn off last; the order of importance of the stop of the lower keyboard from the least important up to the most important being: Gemshorn 8', Superoctave 2', Octave 4', Quinteflöte 1⅓', Waldflöte 2', Rohrflöte 8', Gedackt 8', Flute 4', Clarion 4', Krummhorn 4'.

20. The method according to claim 1, wherein according to said selection rule, if a stop relating to the pedalboard has to be turned off, the following priority order will be applied starting from the most negligible stop, that will be turned off first, up to the most important one, that will be turn off last; the order of importance of the stop of the pedalboard from the least important up to the most important being: Bourdon 8', Subbass 16', Octave 8', Trumpet 8', Choralbass 4'.

21. The method according to claim 1, wherein the deactivation of one or more organ stops aimed at obtaining a number of actually operating stops that does not exceed said maximum number is not notified to the user.

22. An electronic organ having at least one keyboard, one pedalboard, a series of organ stops that can be turned on by the user to associate certain voices to every key and every pedal, and a sound module having a number of independent sound generators; the electronic organ comprising:

a first memory containing a maximum number of organ stops, which can be turned on simultaneously, said maximum number depending on the number of the provided independent sound generators;

a second memory containing a selection rule for turning off said organ stops; and a control device for automatically turning off some of the organ stops according to said selection rule whenever a user turns on a number of stops exceeding said maximum number, so as to obtain a number of actually operating stops which does not exceed said maximum number.

* * * * *